US008991643B2

(12) United States Patent
Wurster et al.

(10) Patent No.: US 8,991,643 B2
(45) Date of Patent: Mar. 31, 2015

(54) CLOSURE FOR USE IN HOTFILL AND PASTEURIZATION APPLICATIONS

(75) Inventors: Michael P. Wurster, York, PA (US); Paul V. Kelley, Wrightsville, PA (US); Scott E. Bysick, Elizabethtown, PA (US)

(73) Assignee: Graham Packaging Company, L.P., York, PA (US)

( * ) Notice: Subject to any disclaimer, the term of this patent is extended or adjusted under 35 U.S.C. 154(b) by 238 days.

(21) Appl. No.: 13/074,820

(22) Filed: Mar. 29, 2011

(65) Prior Publication Data

US 2012/0248127 A1 Oct. 4, 2012

(51) Int. Cl.

| | |
|---|---|
| ***B65D 1/32*** | (2006.01) |
| ***B65D 51/16*** | (2006.01) |
| ***B65D 55/02*** | (2006.01) |
| ***B65D 41/04*** | (2006.01) |
| ***B65D 79/00*** | (2006.01) |

(52) U.S. Cl.

CPC ..... *B65D 41/045* (2013.01); *B65D 79/005* (2013.01)

USPC ..... 220/721; 220/203.01; 215/211

(58) Field of Classification Search

USPC ..... 220/721, 203.01, 203.11, 203.18, 220/203.24, 203.25, 234, 237; 215/211, 215/212, 216, 271, 270, 349

See application file for complete search history.

(56) References Cited

U.S. PATENT DOCUMENTS

| | | | | |
|---|---|---|---|---|
| 3,448,882 | A | 6/1969 | Roy | |
| 3,951,293 | A | 4/1976 | Schulz | |
| 4,002,516 | A * | 1/1977 | Gaborieau et al. | 156/69 |
| 4,135,635 | A * | 1/1979 | Fujii et al. | 220/721 |
| 4,174,784 | A * | 11/1979 | Hartung | 215/349 |
| 6,572,812 | B2 | 6/2003 | Collette et al. | |
| 6,602,309 | B2 | 8/2003 | Vizulis et al. | |
| 7,001,564 | B1 | 2/2006 | Geisinger | |
| 7,107,928 | B2 | 9/2006 | Chasteen et al. | |
| 7,278,548 | B2 | 10/2007 | Rieck et al. | |
| 7,581,654 | B2 | 9/2009 | Stowitts | |
| 7,621,412 | B2 | 11/2009 | Raniwala | |
| 7,832,579 | B2 * | 11/2010 | Lohrman et al. | 215/256 |
| 2007/0224374 | A1 | 9/2007 | Kelley | |
| 2007/0228058 | A1 * | 10/2007 | Brown | 220/796 |
| 2008/0011708 | A1 | 1/2008 | Rappin | |

(Continued)

FOREIGN PATENT DOCUMENTS

| | | |
|---|---|---|
| WO | WO 98/23496 | 6/1998 |
| WO | 2008/065879 | 6/2008 |

*Primary Examiner* — Bryon Gehman
*Assistant Examiner* — Shawn M Braden
(74) *Attorney, Agent, or Firm* — Stradley Ronon Stevens & Young, LLP

(57) ABSTRACT

A closure for a container comprising: a cap member having a top surface, a bottom surface, and a wall portion having an outer surface and an inner surface wherein the inner surface comprises threads to mate with a threaded neck finish of a container; and a composite disc member comprising: an outer vent ring portion comprising a plurality of vents wherein the vents provide a path for air to travel from an area near the threads to an area between the bottom surface of the cap member and the composite disc member, wherein the vent ring portion functions to seal liquid in the container thus preventing the liquid from traveling to the threaded neck finish of the container; and an inner flexible diaphragm portion in a first position, wherein the flexible diaphragm portion flexes to compensate for a change in pressure within the container by transitioning downwards in response to a decrease in pressure and/or by transitioning upwards in response to an increase in pressure.

17 Claims, 10 Drawing Sheets

(56) References Cited

U.S. PATENT DOCUMENTS

| | | | | |
|---|---|---|---|---|
| 2008/0173613 | A1 | 7/2008 | Ross | |
| 2009/0057263 | A1 | 3/2009 | Barker et al. | |
| 2009/0101620 | A1* | 4/2009 | O'Brien | 215/270 |
| 2009/0179032 | A1* | 7/2009 | Livingston | 220/254.7 |
| 2010/0084397 | A1 | 4/2010 | Kubo et al. | |
| 2011/0186536 | A1* | 8/2011 | Wurster et al. | 215/307 |
| 2012/0205339 | A1* | 8/2012 | Bobrov et al. | 215/341 |

* cited by examiner

CLOSURE FOR USE IN HOTFILL AND PASTEURIZATION APPLICATIONS

BACKGROUND OF THE INVENTION

The present invention relates generally to container closures, and more particularly to closures for use in containers that may experience internal pressure changes once sealed such as, for example, hot-fill containers and containers subject to pasteurization processes.

The background of the present invention will be described in connection with closures for hot-fill applications. It should be understood, however, that the use of the closure of the present invention has wider applicability and can be employed on any type of container.

Internally threaded, plastic cap closures have found widespread application for use in connection with hot-fill plastic containers by virtue of their low manufacturing costs and sealing performance. In a conventional hot-fill process, a hot beverage product is introduced into the plastic container, typically filling most of the container. The fluid is heated during a pasteurization or sterilization process to remove bacteria or other contamination. The plastic container is hermetically sealed with a cap while the product is still hot. Since the beverage product is typically not filled to the top of the container, a headspace of air is provided between the liquid enclosed within the plastic container and an inner surface of the cap. The temperature of the liquid varies from a high of about 205° F., the typical hot-fill temperature, to about 40° F., the typical refrigeration temperature. A change in temperature, from hot to cold, decreases the internal pressure of the sealed container and creates a vacuum within the container primarily as a result of the thermal contraction of the liquid in the container. This decrease in pressure can distort and/or deform the geometry of the container if the container cannot structurally support the pressure difference between the external ambient pressure and the lower internal pressure of the container. Deformation of the container generally pushes the fluid upwardly and decreases the headspace volume. For example, for a typical 16-ounce container, thermal contraction equates to roughly 3% of the total liquid volume, or 0.9 cubic inches when the stored contents are cooled from about 185° F. to about 40° F.

Current containers are engineered to collapse at specific locations or are reinforced with vacuum panels and/or flexible bases to compensate for the vacuum. Vacuum-reactive mechanisms are very efficient to maintain a balanced pressure and keep the remaining structural geometry of the container from collapsing. Further, labeling of the container is difficult because containers employing raised and/or recessed vacuum panels possess reduced surface area. The reduction of surface area also restricts the ornamental design of the label, restricts the placement of the label, and often leads to unattractive wrinkling of the label.

There have been attempts to prevent container deformation by designing plastic closures that will compensate for the vacuum created by the cooling of a hot-filled liquid. For example, U.S. Pat. No. 7,621,412 discloses a cap that includes an air permeable membrane covering a through-hole in the cap to permit pressure equalization between the interior of the container and the ambient atmosphere during cooling of the container's contents. This design, however, allows air to be pulled directly into the product and requires the membrane be plugged to seal the contents of the container from further ingress or egress of fluids. U.S. patent application Publication No. 2007/0228058 discloses an expandable plastic closure that flexes in response to pressure. This closure includes a series of elevated substantially flat concentric panels of varying diameters. This design, however, potentially allows for uneven top surfaces of the sealed cooled containers. Finally, U.S. patent application Publication No. 2009/0179032 discloses a plastic closure having an expandable bellows that extend within the neck of the closure. During attachment of such closure to the neck of the container, the bellows is compressed to force air positioned therein into the container which creates a pressure increase within the container. The pressure increase is sufficiently large such that when the container is cooled, a pressure decrease sufficient enough to distort the container allegedly will not form. A disadvantage of this design is that there are multiple components that are susceptible to contamination behind the compressed liner/bellows and the disclosed configuration would not be readily adaptable to a pasteurization process where internal pressure would be increased.

Accordingly, there is a need in the art for a plastic closure that will significantly reduce or prevent container deformation by compensating for the vacuum created by the liquid hot-fill/subsequent cooling process without suffering from the above-mentioned drawbacks.

BRIEF SUMMARY OF THE INVENTION

The present invention satisfies this need by providing a closure for a container comprising: a cap member having a top surface, a bottom surface, and a wall portion having an outer surface and an inner surface wherein the inner surface comprises threads to mate with a threaded neck finish of a container; and a composite disc member comprising: an outer vent ring portion comprising a plurality of vents wherein the vents provide a path for air to travel from an area near the threads to an area between the bottom surface of the cap member and the composite disc member, wherein the vent ring portion functions to seal liquid in the container thus preventing the liquid from traveling to the threaded neck finish of the container; and an inner flexible diaphragm portion in a first position, wherein the flexible diaphragm portion flexes to compensate for a change in pressure within the container by transitioning downwards in response to a decrease in pressure and/or by transitioning upwards in response to an increase in pressure.

The closure of the present invention absorbs the majority if not all of the vacuum generated during product cooling during a typical hot-fill process as a result of the stepped diaphragm which is positioned close to the underside of the closure prior to the hotfill process.

The closure of the present invention also absorbs the majority if not all of the pressure generated and subsequent vacuum of a typical pasteurization process with a diaphragm positioned at a distance below the underside of the closure prior to the pasteurization process.

BRIEF DESCRIPTION OF SEVERAL VIEWS OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the present invention described herein are directed to a device and method for accommodating the internal pressure changes associated with packaging operations such as, for example, hot filling and subsequently cooling a liquid stored in a plastic container, pasteurization, and cold-fill aseptic. By addressing the pressure changes within the container via the closure, vacuum panels on the container walls may be eliminated or reduced.

As used herein, the term "liquid" generally refers to the contents of a container sealed with the closure of the present invention and includes a free flowing substance such as, for example, fruit juice, and sports drinks; however, the term also includes a semi-free flowing substance such as, for example, ketchup and applesauce.

In one embodiment, the present invention provides a closure for a hot-fill container comprising a cap member having a top surface, a bottom surface, and a wall portion having an outer surface and an inner surface wherein the inner surface comprises threads to mate with a threaded neck finish of a hot-fill container. The closure also comprises a composite disc member comprising: an outer vent ring portion comprising a plurality of vents wherein the vents provide a path for air to travel from an area near the threads to an area between the bottom surface of the cap member and the composite disc member. The vent ring portion functions to seal liquid in the container thus preventing the liquid from traveling to the threaded neck finish of the container. The composite disc member also comprises an inner flexible diaphragm portion in a first position, wherein the flexible diaphragm portion flexes to compensate for a change in pressure within the container by transitioning downwards in response to a decrease in pressure and/or by transitioning upwards in response to an increase in pressure. The flexible diaphragm member is capable of moving to a second position after a seal is made and the liquid is either hot filled or heated to a temperature above 100° F. and finally the flexible member is capable of moving to a third position when the liquid is cooled.

The closures of the present invention are suitable for use with any container that may be susceptible to internal pressure changes (increases or decreases). Such container may be metal (e.g., aluminum) or plastic such as, for example plastic containers that are typically blow molded from an injection-molded preform that may be made from various polymer resins, such as polyesters, polyolefins, polycarbonates, nitrites and copolymers thereof. Bi-axially oriented polyethylene terephthalate (PET) is a particularly preferred container.

Processes that may cause internal pressure changes of a sealed container include, for example, hot-fill applications, pasteurization applications, and transportation conditions such as changes in external temperature and pressure.

Figure 1A:
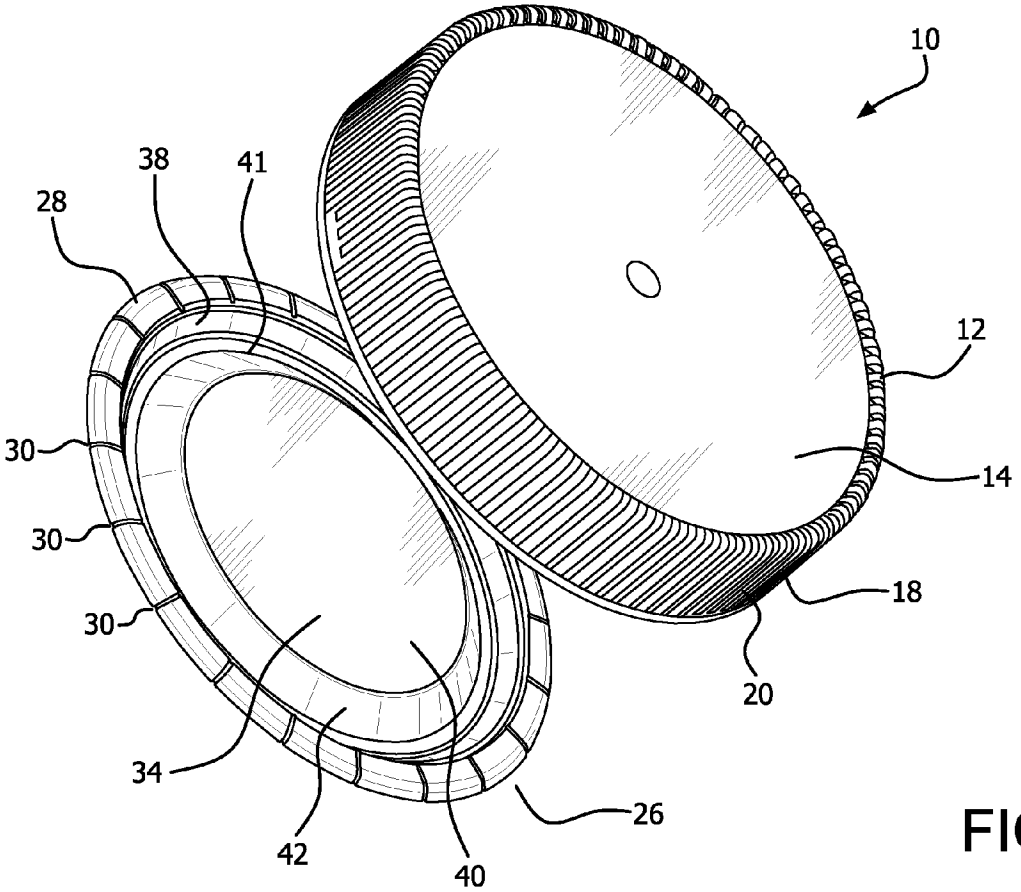
FIG. 1A is a partial top prospective view of an embodiment of a closure of the present invention.
Figure 1B:
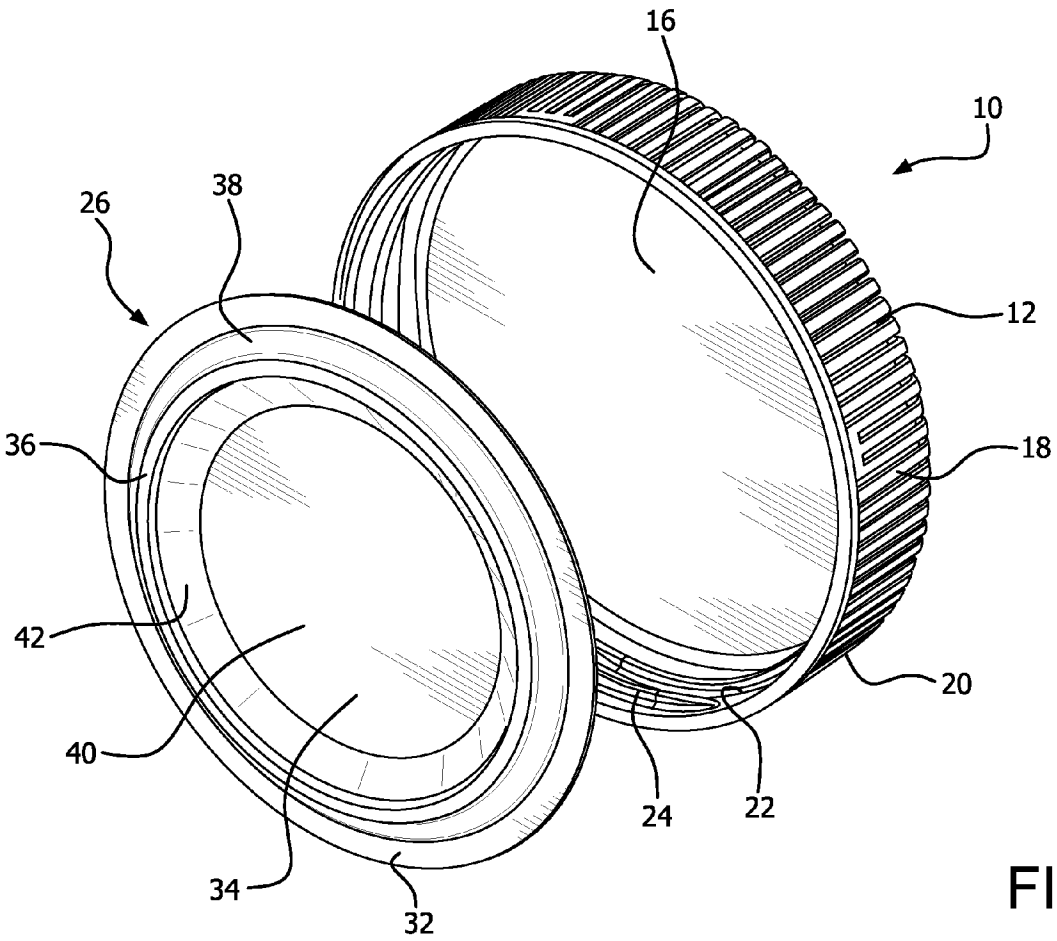
FIG. 1B is a partial bottom view of an embodiment of a closure of the present invention.
Figure 1C:
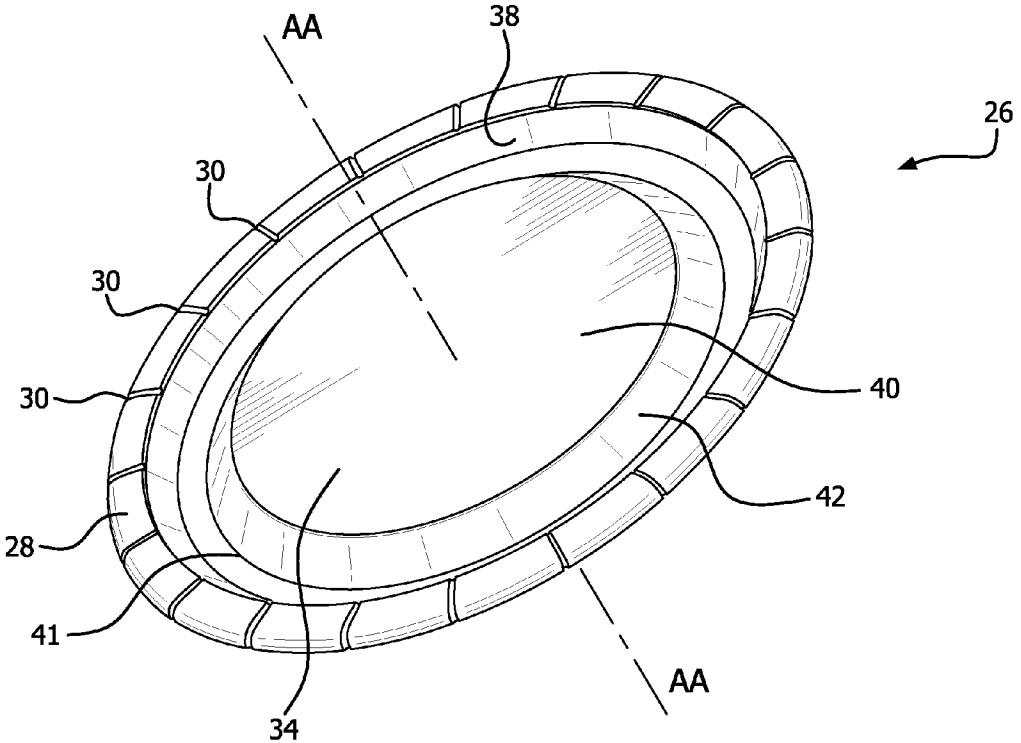
FIG. 1C is a top prospective view of an embodiment of a composite disc member according to the present invention.
Figure 1D:
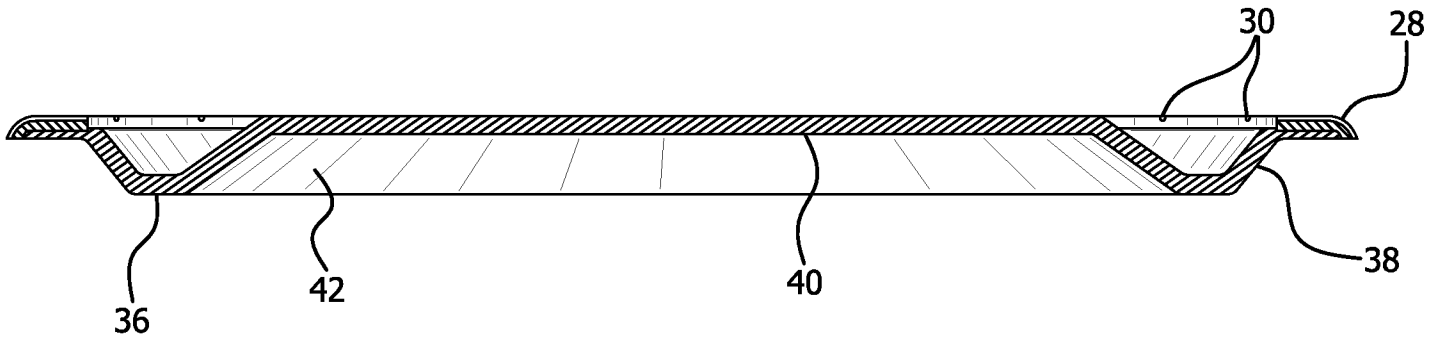
FIG. 1D is a cross-sectional view of the composite disc member of FIG. 3 taken along line AA.

A preferred embodiment of the closure of the present invention is depicted in FIG. 1A and FIG. 1B. Closure 10 is defined by a cap member 12 having a top surface 14, a bottom surface 16, and a wall portion 18 having an outer surface 20 and an inner surface 22 wherein the inner surface 22 comprises threads 24 to mate with a threaded neck finish of a hot-fill container (not shown). Cap member 12 can be made from any suitable polymeric material such as, for example, polypropylene or polyethylene polymer. Closure 10 may also include a tamper-evident ring (not shown).

Still referring to FIG. 1A and FIG. 1B, closure 10 includes a composite disc member 26. Composite disc member 26 includes an outer vent ring portion 28 comprising a plurality of vents 30. The underside of outer vent ring portion 28 comprises sealing lip portion 32. In the present invention, sealing lip portion 32 of the outer vent ring portion 28 functions to seal a liquid in the container thus preventing the liquid from traveling to the threaded neck finish of the container.

Composite disc member 26 further includes flexible diaphragm portion 34 in a first position. In the present invention, flexible diaphragm portion 34 functions to compensate for a change in pressure by, for example, transitioning downwards toward the contents of the container in response to a decrease in head space pressure caused by the cooling of the liquid contents to, for example, at least room temperature and, for some applications, cooler than room temperature. In other embodiments, flexible portion 34 will transition upwards in response to an increase in pressure caused by, for example, a pasteurization process (i.e., prior to a cooling process which would then cause a reversal of the upward transition). Preferably, flexible diaphragm portion 34 responds to such pressure change(s) preferentially over the walls of the container thus allowing the container to substantially maintain its shape after, for example, the container is hot-filled with a liquid, sealed, and the liquid is allowed to cool.

As shown in FIG. 1B, the plurality of vents 30 are grooves that extend outwardly around the vent ring portion 28 from the flexible diaphragm portion 34 towards the area near the threads 24. In the embodiment shown in FIG. 1B, the grooves are spaced apart radially every 18° around composite disc member 26, which is circular in shape. In other embodiments, the grooves can be spaced apart radially every 12°, 15°, 24°, 40°, 60°, or 90°. The vents 30 (i.e., grooves) provide a path through which air travels to/from the area near the threads 24 to/from an area between the bottom surface 16 of the cap member 12 and the composite disc member 26 in response to the movement of the flexible diaphragm portion 34, which, in turn, moves in response to pressure changes inside the container.

Preferably, the area of each groove (i.e., vent) is from about 0.000008 $in^2$ to about 0.00016 $in^2$. A groove having an area of 0.000008 $in^2$ is equivalent in air flow to one 0.003 in. diameter hole. An exemplary ring size of an outer vent ring is, for example, 63 mm or 70 mm, which may have 20 grooves.

Preferably, the total area of all of the grooves is from about 0.0020 $in^2$ to about 0.040 $in^2$ and, more preferably, from about 0.0031 $in^2$ to about 0.0314 $in^2$, which is equivalent in air flow to one 0.020-0.200 in. diameter hole. Air flow can be calculated by employing the following equation:

$$\text{Airflow}(ft^3/hr)=767\times\text{Total Groove Area}(in^2)\times\text{Pressure (psig)}$$

As used herein, the term "air flow" refers to the estimated flow rate of air through the vents at the supplied pressure at 70° F. The term "estimated" means±15%.

In the embodiment shown in FIG. 1A and FIG. 1B, flexible diaphragm portion 34 comprises a recessed portion 36 (i.e., relative to outer vent ring portion 28/sealing lip portion 32), the depth of which is defined by the depth of recessed wall 38, and a raised portion 40, the height of which is defined by the height of wall 42. The flexible diaphragm portion 34 also comprises at least one hinge portion 41 that allows the diaphragm to flex in response to a change in pressure by increasing the potential volumentric displacement over and above the material properties of the diaphragm. Wall 42 may be designed such that it has less material so it may respond more readily to changes in pressure within a sealed container. In other embodiments of the present invention, flexible diaphragm portion 34 may have the shape of a bellows, may be flat, or may have a plurality of bubble-like portions each of which respond to changes in head space pressure.

Preferably, flexible diaphragm portion 34 is made of a flexible plastic material. Suitable flexible plastic materials include, for example, any suitable thermoplastic polymer, thermoset rubber, or co-polymer or mixture thereof. Preferred thermoplastic polymers are generally: elastomer (TPE) styrenics; polyolefins (TPO), low density polyethylene (LDPE), high-density polyethylene (HDPE), linear low-density polyethylene (LLDPE), ultra low-density polyethylene (ULDPE); polyurethanes (TPU) polyethers and polyesters; ether-esterelastomers (TEEEs) copolyesters; polyamides (PEBA); melt processible rubbers (MPR); vulcanizates (TPV); and mixtures and/or co-polymers thereof. Preferred thermoset rubbers are generally: butadiene rubber (BR); butyl rubber (IIR or PIB); chlorosulfonated polyethylene (CSM); epichlorohydrin rubber (ECH or ECO); ethylene propylene diene monomer (EPDM); ethylene propylene rubber (EPR); floroelastomers (FKM); nitrile rubber (NBR); perfluoroelastomer (FFKM); polyacrylate rubber (ASM); polycholorprene (CR); polyisoprene (IR); polysulfide rubber (PSR); silicon rubber (SiR); styrene butadiene rubber (SBR); and mixture and/or co-polymers thereof.

In a preferred embodiment, flexible diaphragm portion 34 is made of a thermoplastic eslastomer. Preferably the thermoplastic elastomer is an elastomeric material derived from ethylene propylene diene monomer (EPDM). More preferably, the thermoplastic elastomer is a mixture of in-situ cross linking of ethylene propylene diene monomer (EPDM) and polypropylene (e.g., a Santoprene™ polymer available from ExxonMobil Chemical Company, Houston, Tex.).

In preferred embodiments of the present invention, the material from which the flexible diaphragm portion 34 is made preferably has a Shore Hardness (A) of from 25 to 65, and more preferably from 25 to 45. Shore Hardness is typically measured according to ASTM D2240.

Preferably, outer vent ring portion 28 of composite disc member 26 is made from a material having a Rockwell Hardness of >80 and/or a Modulus of Elasticity (psi) of >150,000. Rockwell Hardness is typically measured according to ASTM D785. Such materials include polypropylene, nylon, acrylonitrile butadiene styrene polymer, polycarbonate, HDPE. Polypropylene is preferred.

Composite disc member 26 can be made, for example, by a two-material over-molding injection molding process familiar to one of ordinary skill in the art. Examples of such over-molding processes are found in U.S. Pat. No. 6,572,812 and U.S. patent application Publication No. 2007/0224374, the disclosures of which are incorporated herein by reference. In such process, two molds are employed—one for the outer vent ring portion 28 and one for the flexible diaphragm portion 34. The outer vent ring portion 28 is typically injected first followed by the flexible diaphragm portion 34.

The following explains the operation of closure 10 in the context of a hot-fill application and is not intended to be limited thereto. In operation, closure 10 is placed on the neck of a portion of a container and after the container is hot-filled (e.g., 205° F.) with a liquid beverage. Upon contact, sealing lip portion 32 of outer vent ring portion 28 of composite disc member 26 forms a seal with the container thus preventing the liquid from traveling to the threaded neck finish of the container. The seal also prevents the escape of gas located in the headspace of the container. As the liquid cools, the internal pressure of the sealed container decreases and creates a vacuum within the container primarily as a result of the thermal contraction of the liquid in the container. In response to the internal pressure decrease, flexible diaphragm portion 34 flexes downward towards the liquid and pulls air into a space between flexible diaphragm portion 34 and the bottom surface 16 of cap member 12 thus reducing the pressure in the container (which includes the headspace). The air is pulled by the diaphragm through the vents 30 from the area of the threads 24. In response to a pressure increase, the flexible diaphragm portion 34 will transition upward towards the bottom surface 16 of cap member 12 and push air through vents 30 to the the area of the threads 24. Thus, the closure of the present invention will allow for pressure changes under conditions where the internal pressure of the container decreases and/or increases.

Figure 2:
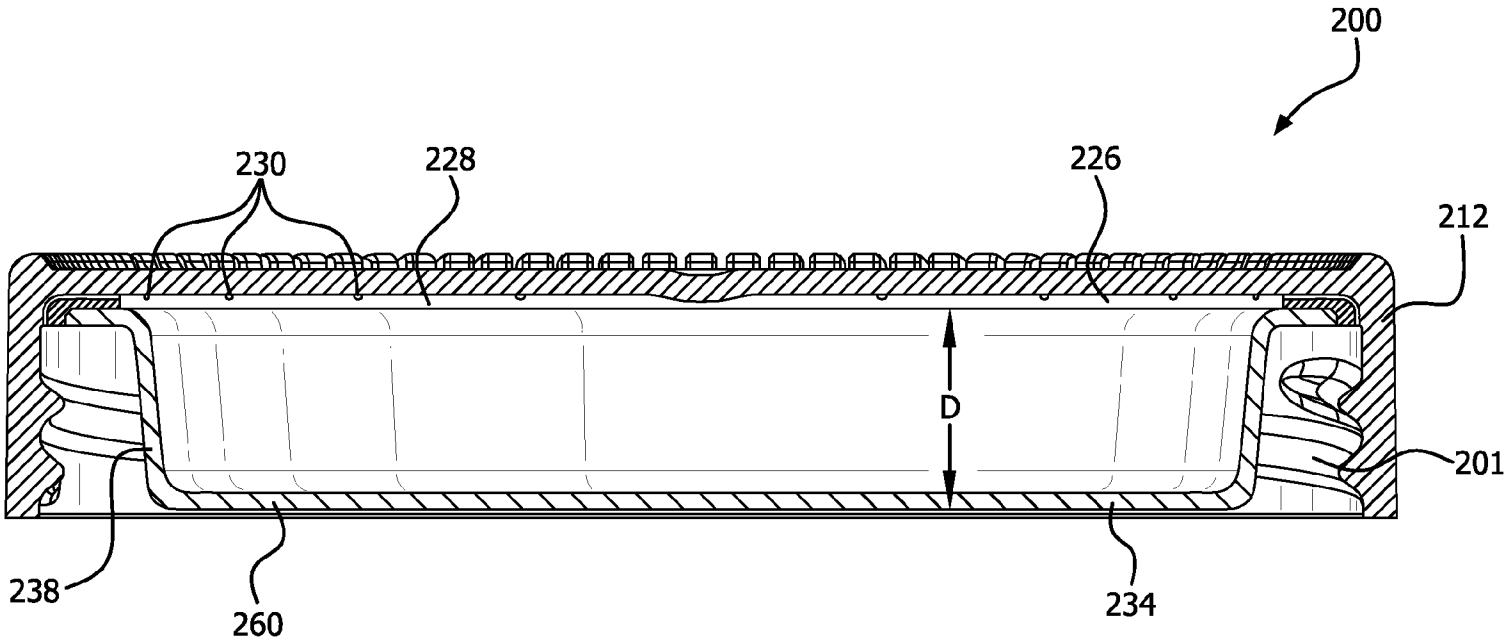
FIG. 2 is a cross-sectional view of another embodiment of a closure of the present invention.

Another embodiment of a closure of the present invention is illustrated in FIG. 2. In FIG. 2, a cross-section of closure 200 is shown mated with threaded neck finish 201. Closure 200 comprises cap member 212 and composite disc member 226. Composite disc member 226 comprises outer vent ring portion 228 comprising a plurality of vents 230. Like the outer vent ring portion shown in FIGS. 1A-1D, the outer vent ring portion 228 functions to seal liquid in the container thus preventing the liquid from traveling to the threaded neck finish of the container. Composite disc member 226 further comprises an inner flexible diaphragm member 234. In the embodiment shown in FIG. 2, inner flexible diaphragm member 234 has a wall portion 238 and a bottom portion 260. Inner flexible diaphragm member 234 has a depth, D, that is defined by the depth of wall portion 238. The outer vent ring portion 228 and the inner flexible diaphragm member 234 are preferably made from the same materials as detailed above with respect to the embodiment of FIGS. 1A-1D.

Figure 3:
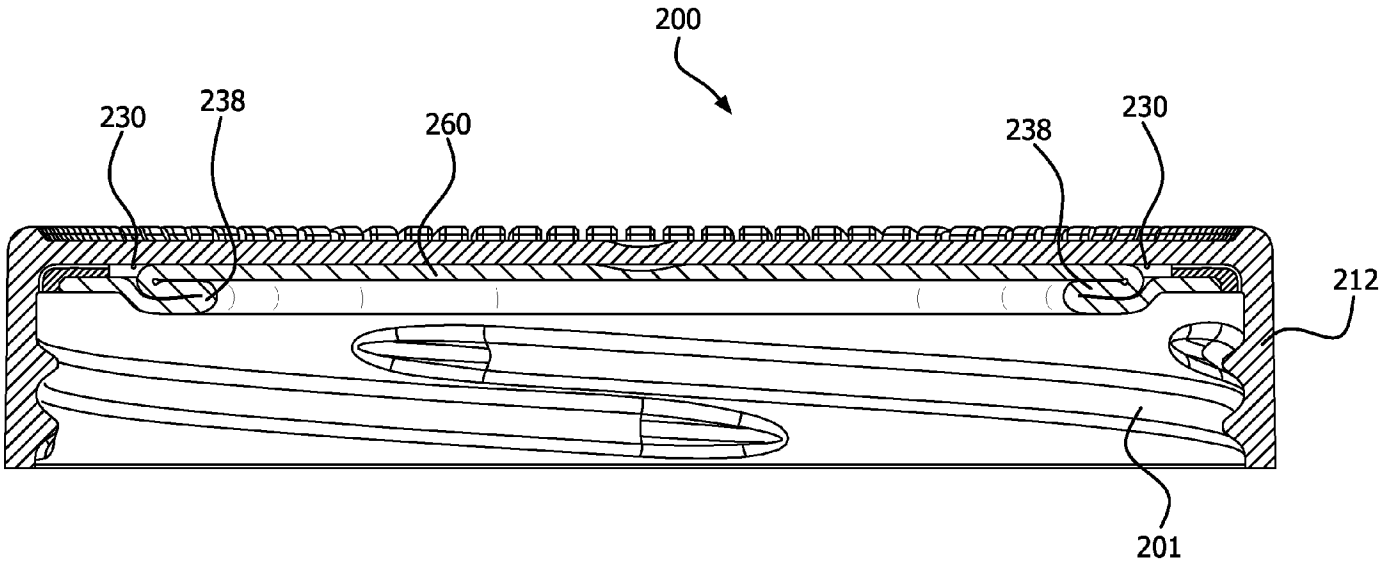
FIG. 3 is a cross-sectional view of the closure of FIG. 2 in response to an over pressure environment.
Figure 4:
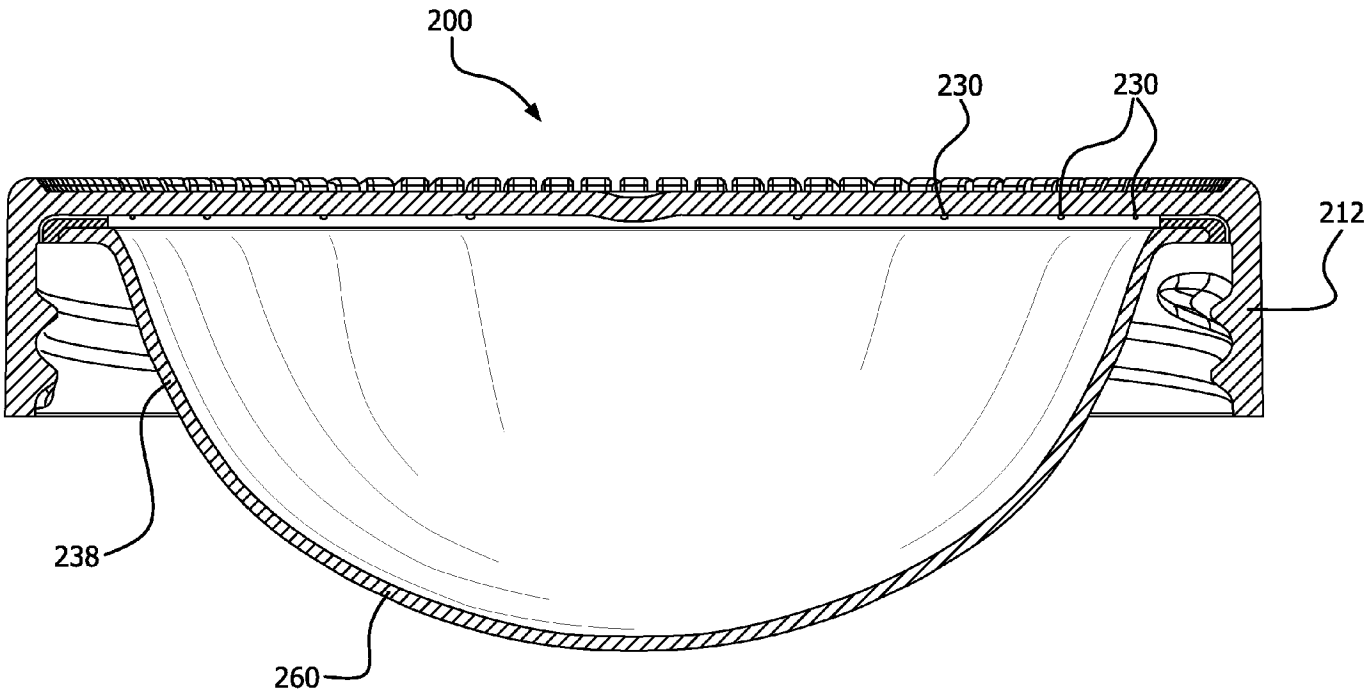
FIG. 4 is a cross-sectional view of the closure of FIG. 2 in response to a vacuum environment.

The embodiment of FIG. 2 is particularly suitable to respond to both over pressure conditions as well as vacuum conditions to maintain an equalized environment in a sealed container. Referring now to FIG. 3, closure 200 is shown in response to an over pressure condition such as, for example, that experienced by a sealed container experiencing a retort or pasteurization process. In response to an increase in pressure within the container, bottom portion 260 is flexed upward and the air that was between bottom portion 260 and the bottom surface of the cap member 212 is pushed through vents 230 toward the area near the threads. FIG. 4 shows the same closure in response to a vacuum environment wherein bottom portion 260 is pulled down toward the contents of the container and air is pulled from the area near the threads through vents 230 into the space between bottom portion 260 and the bottom surface of the cap member 212.

An advantage to embodiments of the present invention is that the closure may accept all of the volume change of a hot-filled container where other closures cannot. Embodiments of the closure may be molded from a plastic or other suitable flexible material, and may change shape to compensate for the change in internal pressure due to hot fill. Compensating for the pressure change primarily in the closure rather than the container body will allow greater design freedom for label panels, and assist in reducing the weight of the container.

In an exemplary embodiment, the closure may have a diameter of greater than or equal to 28 millimeters (mm). In another exemplary embodiment, the closure may have a diameter of up to about 120 mm. In another exemplary embodiment, the closure may have a diameter of between about 63 mm to about 120 mm. In another exemplary embodiment, the closure may be used on containers of between about eight ounces to about five gallons.

The following examples are provided for the purpose of further illustrating the present invention but are by no means intended to limit the same.

EXAMPLES

Hot Fill—Heavyweight Ribbed 24 oz PET Container v. Lightweight Thin-Walled 24 oz PET Container without Ribs or Pannels 63 mm three-component closures according to the present invention were made as follows. The liner was removed from a commercially available 63 mm plastic closure and fitted with a 63 mm composite disc having an outer vent ring portion comprising 20 vents spaced circumferentially every 18° and a flexible diaphragm portion having a simple hinged liner design. This composite disc member was fabricated in house with a Santoprene® flexible diaphragm portion and a polypropylene outer vent ring portion by a two-step overmolding process. In this experiment, the composite disc was that depicted in FIGS. 1A-1D.

For this experiment, two types of bottles were employed for comparison. the first type of bottles were lightweight (~39 g), 24 oz, thin walled (~0.018") plastic PET bottles with no vacuum panels, rib structure, or any other means of passive vacuum displacement. The second type of bottles were heavyweight (~48 g), 24 oz, plastic PET bottles with rib structures (0.022" wall thickness).

For each type of container, two of the containers were hot-filled at 200° F. wherein one was capped with a standard one piece 63 mm closure (as a control), and the other was capped with the above-assembled closure according to the present invention. The control closure was a 63 mm an all-plastic closure with a standard sealing liner made by Silgan Whitecap Americas (Downers Grove, Ill.).

Figure 5:
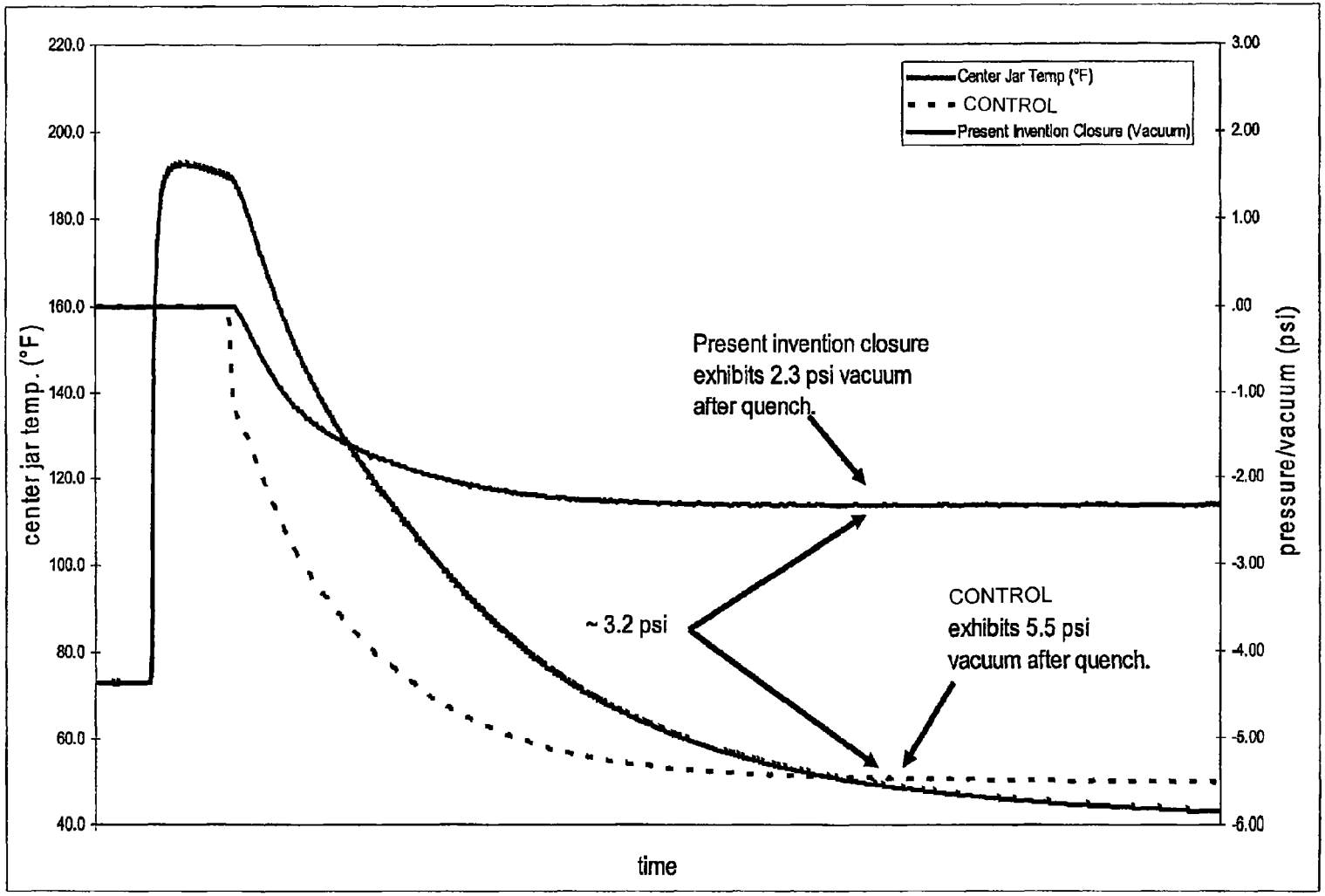
FIG. 5 is a graph illustrating the performance of the embodiment of the present invention shown in FIG. 1 compared to a standard closure.
Figure 6:
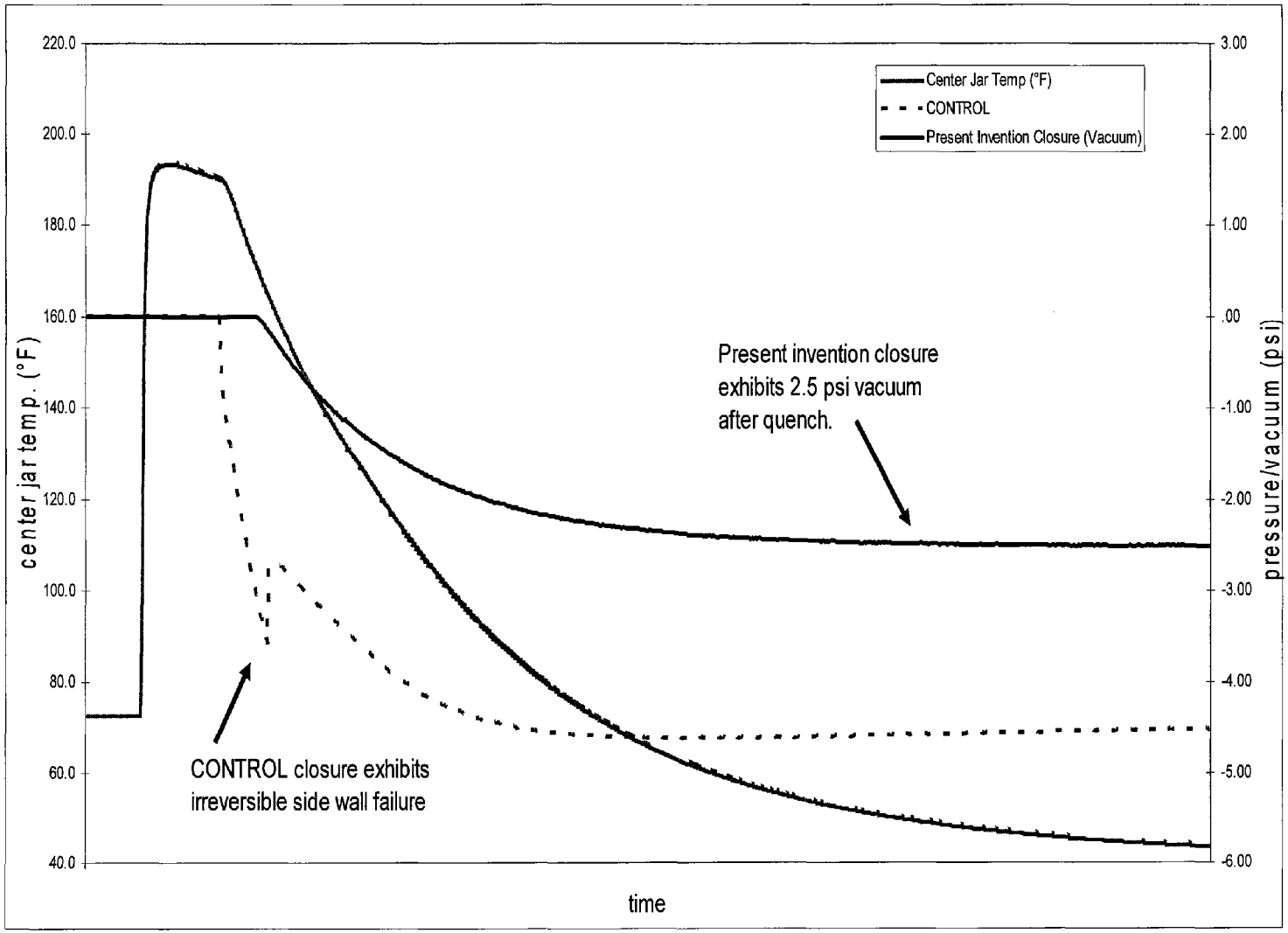
FIG. 6 is a graph illustrating the performance of the embodiment of the present invention shown in FIG. 1 compared to a standard closure.

The results are shown graphically in FIGS. 5 and 6. FIG. 5 shows that the closure of the present invention achieved a vacuum of about −2.5 psi versus about −5.5 psi in the standard closure when employed with the heavyweight container. FIG. 6 shows that the lightweight container with the standard closure exhibited irreversible side wall failure as the liquid cooled. The container with the vacuum closure of the present invention, however, remained round with minimal ovality. This experiment also shown that the closure of the present invention can be used to achieve lighter weighted containers without sacrificing performance for hot fill applications.

Overpressure Experiments 70 mm three-component closures according to the present invention were made as follows. The liner was removed from a commercially available 70 mm plastic closure and fitted with a 70 mm composite disc having an outer vent ring portion made from polypropylene and comprising 20 vents spaced circumferentially every 18° and a flexible diaphragm portion made from Plastisol (PVC+platicizer). This composite disc member was fabricated by a two-step overmolding process. In this experiment, the composite disc was that depicted in FIG. 2.

For this experiment, commercial 45 g 20 oz 70 mm pasteurizable PET jars having a wall thickness of about 0.028 in. were employed.

The control closure was a 70 mm all-plastic closure with a standard sealing liner made by Silgan Whitecap Americas (Downers Grove, Ill.). The small scale test compared prior art (i.e., control) closures to the pressure/vacuum diaphragm closure of the present invention. Samples were filled w/120° water and then subjected to a 194° F. rain for 20 minutes. Center jar temperature and pressure data was collected to evaluate results.

Figure 7:
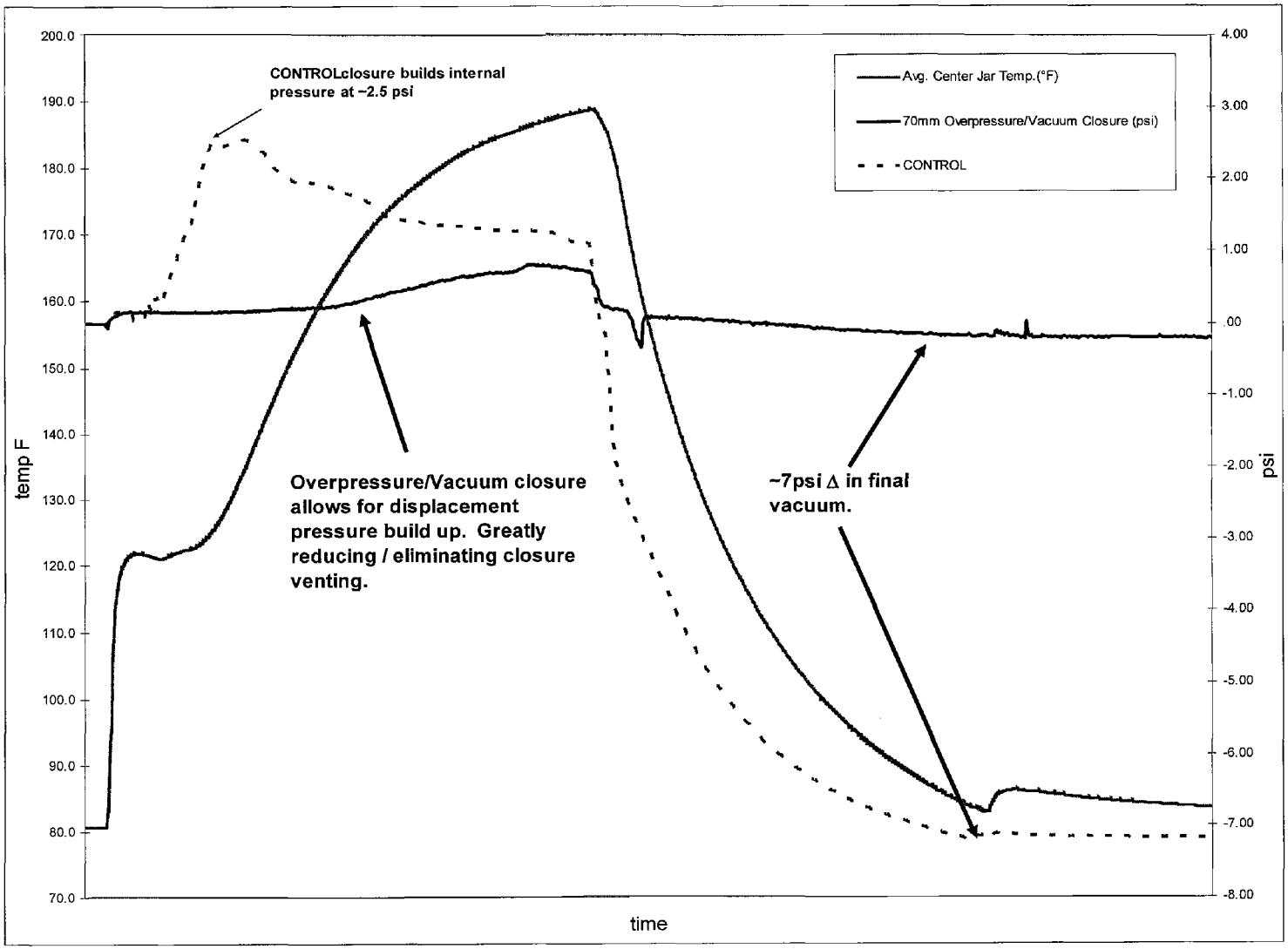
FIG. 7 is a graph illustrating the performance of the embodiment of the present invention shown in FIG. 2 compared to a standard closure.

The results are shown graphically in FIG. 7. FIG. 7 shows that the closure of the present invention allowed for displacement of the pressure build up and equalized the pressure in the container throughout the temperature cycle. The internal pressure of the container with the control closure builds initially to about 2.5 psi, which may result in a seal breaking or container distortion. At the end of the cycle, the internal pressure of the container with the control closure was about −7.0 psi, which will deform most containers or at least require that the container be designed to withstand such vacuum displacement. As an added benefit, the decease in headspace that the overpressure/vacuum closure provides would displace additional headspace $O_2$ when compared to prior art closures which is helpful to reduce oxidization of food product stored in container.

The foregoing examples and description of the preferred embodiments should be taken as illustrating, rather than as limiting the present invention as defined by the claims. As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

The invention claimed is:

1. A closure for a container comprising:

a. a cap member having a top surface, a bottom surface, and a wall portion having an outer surface and an inner surface wherein the inner surface comprises threads to mate with a threaded neck finish of a container; and b. a composite disc member comprising:

i. an outer vent ring portion comprising a plurality of vents wherein the vents provide a path for air to travel from an area near the threads to an area between the bottom surface of the cap member and the composite disc member, wherein the vent ring portion functions to seal liquid in the container thus preventing the liquid from traveling to the threaded neck finish of the container; and ii. an inner flexible diaphragm portion, wherein the inner flexible diaphragm portion comprises a bottom portion and a recessed wall such that the bottom portion is recessed relative to the outer vent ring portion at a depth defined by the recessed wall to define an initial position, wherein the inner flexible diaphragm portion is capable of flexing both downwards from the initial position in response to a decrease in pressure within the container and upwards from the initial position in response to an increase in pressure within the container, and wherein the initial position of the inner flexible diaphragm portion is a position prior to the closure being mated with a threaded neck finish of a container.

2. The closure of claim 1 wherein each vent comprises a groove that extends from the area near the threads towards the inner flexible diaphragm portion.

3. The closure of claim 1 wherein the outer vent ring portion of the composite disc member is made from a polymer material having a Rockwell Hardness of greater than 80.

4. The closure of claim 1 wherein the outer vent ring portion of the composite disc member is made from a polymer material having a Modulus of Elasticity of greater than 150,000.

5. The closure of claim 1 wherein the inner flexible diaphragm portion of the composite disc member is made from an elastic material having a Shore Hardness of 25to 65.

6. The closure of claim 1 wherein the outer vent ring portion of the composite disc member is made from polypropylene, nylon, acrylonitrile butadiene styrene polymer, polycarbonate, and HDPE.

7. The closure of claim 6 wherein the outer vent ring portion of the composite disc member is made from polypropylene.

8. The closure of claim 1 wherein the inner flexible diaphragm portion of the composite disc member is made from a thermoplastic polymer selected from the group consisting of: elastomer styrenics, polyolefins, low density polyethylene, high-density polyethylene, linear low-density polyethylene, ultra low-density polyethylene, polyurethanes polyethers and polyesters, etheresterelastomers copolyesters, polyamides, melt processible rubbers, vulcanizates, and mixtures and co-polymers thereof.

9. The closure of claim 1 wherein the inner flexible diaphragm portion of the composite disc member is made from a thermoset rubber selected from the group consisting of: butadiene rubber, butyl rubber, chlorosulfonated polyethylene, epichlorohydrin rubber, ethylene propylene diene monomer, ethylene propylene rubber, floroelastomers, nitrile rubber, perfluoroelastomer, polyacrylate rubber, polycholorprene, polyisoprene, polysulfide rubber, silicon rubber, styrene butadiene rubber, and co-polymers thereof.

10. The closure of claim 9 wherein the inner flexible diaphragm portion comprises a thermoplastic elastomer resulting from in-situ cross linking of ethylene propylene diene monomer and polypropylene.

11. The closure of claim 1 wherein the total area of all of the grooves is from 0.0020 $in^2$ to 0.040 $in^2$.

12. The closure of claim 11 wherein the total area of all of the grooves is from 0.0031 $in^2$ to 0.0314 $in^2$.

13. The closure of claim 1 wherein the vents are be spaced apart radially at 12°, 15°,18°, 24°, 40°, 60°, or 90°.

14. The closure of claim 1 wherein the vents are be spaced apart radially every 18°.

15. The closure of claim 1 wherein the inner flexible diaphragm portion comprises a thermoplastic elastomer resulting from in-situ cross linking of ethylene propylene diene monomer and polypropylene; and the outer vent ring portion of the composite disc member is made from polypropylene.

16. The closure of claim 1 wherein the flexible portion of the flexible diaphragm comprises a plurality of bubble shapes.

17. The closure of claim 1 wherein the flexible diaphragm portion comprises a recessed portion relative to the outer vent ring portion having a depth defined by the depth of a recessed wall; at least one hinge portion; and a raised portion having a height defined by the height of the wall.

* * * * *

UNITED STATES PATENT AND TRADEMARK OFFICE

CERTIFICATE OF CORRECTION

PATENT NO. : 8,991,643 B2
APPLICATION NO. : 13/074820
DATED : March 31, 2015
INVENTOR(S) : Michael P. Wurster et al.

It is certified that error appears in the above-identified patent and that said Letters Patent is hereby corrected as shown below:

In the Claims:

Claim 5 at Column 9 within Line 16 change "of 25to 65." to --of 25 to 65.--.

Claim 13 at Column 10 within Line 16 change "the vents are be spaced" to --the vents are spaced--.

Claim 14 at Column 10 within Line 18 change "the vents are be spaced" to --the vents are spaced--.

Signed and Sealed this
Twenty-ninth Day of December, 2015

Michelle K. Lee

Michelle K. Lee
*Director of the United States Patent and Trademark Office*